US005694916A

United States Patent [19]

Gambill et al.

[11] Patent Number: 5,694,916

[45] Date of Patent: Dec. 9, 1997

[54] ONE BUTTON GAS SHUTOFF APPARATUS

[75] Inventors: Kenneth F. Gambill, Randolph Township, Montgomery County, Ohio; David M. Shellito, Varese, Italy

[73] Assignee: Whirlpool Corporation, Benton Harbor, Mich.

[21] Appl. No.: 289,212

[22] Filed: Aug. 12, 1994

[51] Int. Cl.[6] ..... F24C 3/12

[52] U.S. Cl. ..... 126/42; 126/39 BA; 126/39 F; 126/52

[58] Field of Search ..... 126/42, 39 BA, 126/39 E, 52

[56] References Cited

U.S. PATENT DOCUMENTS

| | | | |
|---|---|---|---|
| 1,956,514 | 4/1934 | Olson | 126/42 |
| 2,413,237 | 12/1946 | Jones | 126/42 |
| 2,489,611 | 11/1949 | Becvar | 126/42 |
| 2,691,705 | 10/1954 | Ray | 200/61.86 |
| 2,749,903 | 6/1956 | Auster | 126/42 |
| 3,176,754 | 4/1965 | Macios | 431/15 |
| 3,392,720 | 7/1968 | Sherman | 126/211 |
| 3,875,956 | 4/1975 | Katchka | 137/65 |
| 4,974,624 | 12/1990 | Gotanda | 137/78.4 |
| 5,400,766 | 3/1995 | Dillon | 126/42 |

*Primary Examiner*—Larry Jones
*Attorney, Agent, or Firm*—Hill, Steadman & Simpson

[57] ABSTRACT

An apparatus for controlling a gas supply to a gas appliance, having valve means disposed in a gas supply and an activation means for controlling the valve means. In a preferred embodiment, the present invention is used in a free-standing gas range having a control panel whereon the activation means which is a rotary mechanical knob is disposed. Further, the valve means used in the gas shutoff apparatus is mechanically activated. In a further embodiment, the apparatus for controlling a gas supply to a free-standing gas range having a control panel whereon the activation means is disposed, further has an electrical push-button switch which controls an electromechanically activated valve means.

8 Claims, 1 Drawing Sheet

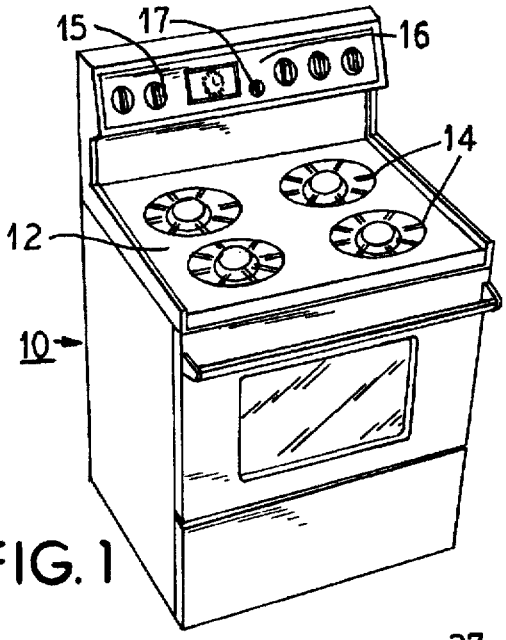
FIG. 1
FIG. 2
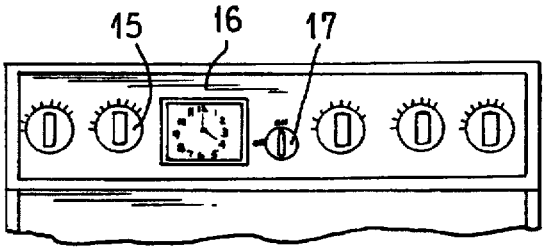
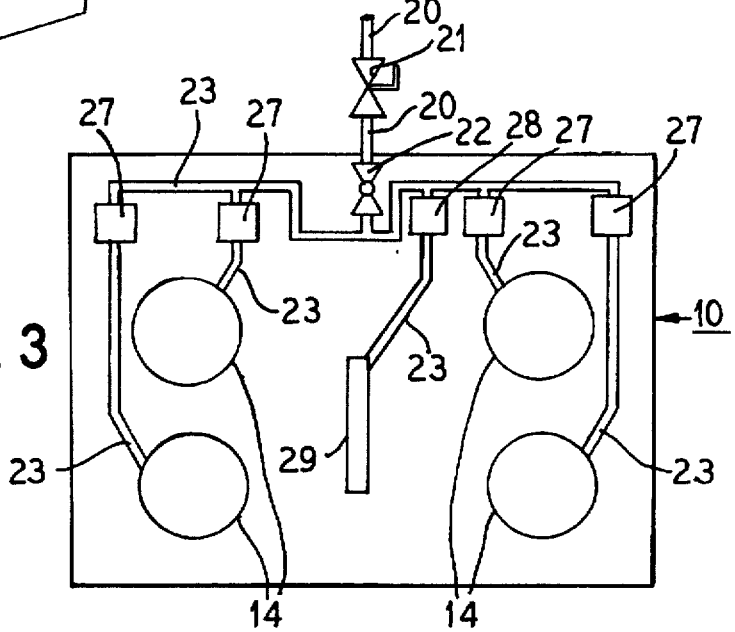
FIG. 3
FIG. 4
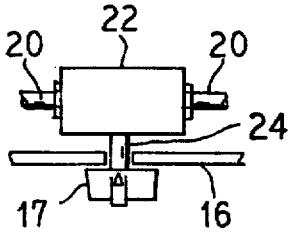
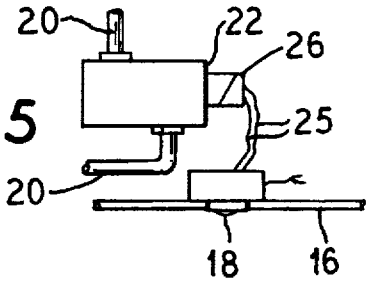
FIG. 5

ONE BUTTON GAS SHUTOFF APPARATUS

BACKGROUND OF THE INVENTION

The present invention relates to gas shutoffs and more particularly to a gas shutoff having a single button for use in association with appliances, such as gas ranges.

Certain appliances, such as gas ranges and cooktops that use gas for cooking may cause certain safety risks related to gas leaks and the associated dangers arising therefrom. There are a variety of reasons why a user may want to shut off the gas to a free-standing gas range or other appliance. Some of these include, for example, when a homeowner goes out and has a babysitter in for the evening, the owner may want to shut off the gas to the range so that the babysitter could not use the range while the owner was out. Also, in remote locations, such as at a lake cabin, a user might desire to turn off the gas and have it remain off while the user was away from the cabin. This is another use for a gas shutoff.

U.S. Pat. No. 2,691,705 relates to a device which utilizes a circuit control means in conjunction with a valve means to provide a combination pilot burner and safety burner valve protective feature. An embodiment of the device uses a push button.

U.S. Pat. No. 3,176,754 relates to a control device which uses a solenoid and an operating member in a control circuit to prevent operation of a range by a small child. An embodiment of this invention locates it on the control panel out of reach of small children. This device does not use a single button to shut off all gas to the range via a controlled valve in the supply line.

U.S. Pat. No. 3,875,956 relates to a control device which uses a dial for operation and a push button safety device provides a locking means. This device does not use one button to shut off all gas to a range.

U.S. Pat. No. 4,974,624 relates to a device which utilizes permanent magnets and a solenoid to automatically shut off a flow of gas. This device may also be reset by a push button. This invention relates primarily to a gas sensing device which turns off the gas automatically. The invention is preferably used in homes to shut off the gas supply when the sensing means detects a gas leak due to an earthquake or other calamity.

SUMMARY OF THE INVENTION

The present invention provides a simple and effective solution for shutting off the main gas line to a gas appliance with a one button shutoff apparatus.

The objects of the present invention are inventively achieved in an apparatus for controlling a gas supply to a gas appliance, having valve means disposed in a gas supply and an activation means for controlling the valve means. In a preferred embodiment, the present invention is used in a free-standing gas range having a control panel whereon the activation means which is a rotary mechanical knob is disposed. Further, the valve means used in the gas shutoff apparatus is mechanically activated. In a further embodiment, the apparatus for controlling a gas supply to a free-standing gas range having a control panel whereon the activation means is disposed, further has an electrical push-button switch which controls an electromechanically activated valve means.

BRIEF DESCRIPTION OF THE DRAWINGS

FIG. 1 is a perspective view of an appliance illustrating a gas cooktop having a control panel in which a one button gas shutoff apparatus embodying the principles of the present invention could be used.

FIG. 2 is a control panel of the present invention illustrating the location of the gas shutoff control.

FIG. 3 is a schematic of the gas flow of the range of the present invention.

FIG. 4 illustrates an embodiment of the apparatus of the present invention.

FIG. 5 illustrates another embodiment of the apparatus of the present invention.

DESCRIPTION OF THE PREFERRED EMBODIMENTS

FIG. 1 illustrates an appliance generally at 10 which in the illustration shows a gas range, although the present invention can be utilized with other types of appliances, such as stand-alone cooktops and other gas-operated devices.

The range 10 has a top cooking surface 12, commonly referred to as a cooktop, which includes a plurality of gas burners 14 controlled by control knobs 15 located on a rear control panel 16. Four such gas burners 14 are shown in FIG. 1.

FIG. 2 illustrates the control panel 16 portion of the gas range 10. An embodiment of a gas shutoff control 17 is illustrated. The gas shutoff control 17 enables a user to disconnect the incoming gas to the range 10 by operating the single control 17. The user does not have to have access to the main gas shutoff 21 at the back of the range to disable the gas, as is presently the case in current gas appliances. The gas shutoff control 17 is placed in an area which is away from the reach of young children. An embodiment of the control 17 can be of the key-lock type. This type of device could be used to prevent access by unauthorized users of the range 10 by the owner.

FIG. 3 shows a generalized schematic of the gas flow for a gas range 10 of the present invention. As illustrated, a main gas line 20 is connected to the range 10 through a main manual valve 21. The main manual valve 21 provides a means to shut off the gas supply in a manual way; the main manual valve 21 is usually located behind the range 10. The main gas line 20 then connects to a one-button gas shutoff 22 that is the crux of the present invention. After the one-button gas shutoff 22, the gas is fed to each of the individual burners 14 via individual burner lines 23 and to an oven burner 29.

FIG. 4 illustrates an embodiment of the present invention. The gas shutoff control 17 operates to shut off the gas to the entire range by using the gas shutoff 22 in the main gas line 20 of the range 10. The gas shutoff 22 is operated by rotating the control 17 which in turn rotates a shaft 24 to shut off all gas to the range 10. The gas shutoff 22 thereby shuts off the gas flow through the main gas line 20. The gas shutoff 22 is operated as a mechanical valve in this embodiment.

FIG. 5 illustrates another embodiment of the present invention. As illustrated, a push-button gas shutoff control 18 is connected to the control panel 16. The push-button control 18 has electrical connectors 25 between it and an electromechanical controller 26 that is used with the gas shutoff 22 to shut off the gas flowing through the main gas line 20. The gas shutoff 22 is, for example, operated as an electromechanical valve in this embodiment. In one embodiment, the push-button control 18 could provide a momentary impulse to change the state of the gas shutoff 22. Upon a loss of power, the shutoff 22 would remain in its previous state. In another embodiment, the push-button control 18 and controller 26 would keep the gas shutoff 22 open as long as power is supplied to the push-button 18 or unless the push-button 18 was activated to close the shutoff 22. Thus, if power were lost, the shutoff 22 would be automatically closed if it wasn't already in that state. In another embodiment, the push-button control 18 and controller 26 would operate as selected so long as power is supplied, but if power were lost, the valve would open to allow cooking to continue even if electrical power were not available.

Referring again to FIG. 3, the amount of gas supplied to each burner 14 is individually adjusted by its associated control knob 15 on the control panel 16 (see FIG. 2). Also, each burner 14 can be shut off individually by using the associated control knob 15 to actuate an individual burner shutoff 27 and an oven burner shutoff 28. This individual shutoff capability is in addition to the main shutoff 22 embodied in the present invention.

As is apparent from the foregoing specification, the invention is susceptible of being embodied with various alterations and modifications which may differ particularly from those that have been described in the preceding specification.

It should be understood that we wish to embody within the scope of the patent warranted hereon, all such modifications as reasonably and properly come within the scope of our contribution to the art.

The embodiments of the invention in which an exclusive property or privilege is claimed are therefore defined as follows:

1. A single control apparatus for controlling a gas supply to a free-standing gas range, consisting of:

a valve on the range disposed in a main gas supply line leading to a plurality of gas cooking burners;

a manual control knob connected directly to said valve for controlling said valve; and a control panel having a back side, wherein said control knob is located on said back side.

2. The apparatus of claim 1, including an electromechanical controller for said valve.

3. The apparatus of claim 1, wherein said valve is electromechanically activated.

4. The apparatus of claim 1, wherein said valve is mechanically activated.

5. The apparatus of claim 1, wherein said manual control knob is a rotary mechanical knob.

6. The apparatus of claim 1, wherein said manual control knob is an electrical push-button switch.

7. The apparatus of claim 1, wherein said valve is mechanically activated, and said manual control knob is a rotary mechanical knob.

8. The apparatus of claim 1, wherein said valve is electromechanically activated, and said manual control knob is an electrical push-button switch.

* * * * *